US009351550B2

(12) United States Patent
Arthur et al.

(10) Patent No.: US 9,351,550 B2
(45) Date of Patent: May 31, 2016

(54) WHEEL DEPLOYMENT APPARATUS

(71) Applicants: Joseph I. Arthur, Palm Bay, FL (US); Aron Bacs, Jr., Orlando, FL (US)

(72) Inventors: Joseph I. Arthur, Palm Bay, FL (US); Aron Bacs, Jr., Orlando, FL (US)

(73) Assignee: Retrac Enterprises INC, Palm Bay, FL (US)

( * ) Notice: Subject to any disclaimer, the term of this patent is extended or adjusted under 35 U.S.C. 154(b) by 0 days.

(21) Appl. No.: 14/267,496

(22) Filed: May 1, 2014

(65) Prior Publication Data

US 2015/0313333 A1 Nov. 5, 2015

(51) Int. Cl.
*A45C 5/14* (2006.01)
*A45C 13/26* (2006.01)

(52) U.S. Cl.
CPC ..... *A45C 5/146* (2013.01); *A45C 13/262* (2013.01); *A45C 2005/148* (2013.01); *A45C 2013/267* (2013.01)

(58) Field of Classification Search
CPC ..... A45C 5/146; A45C 2013/267; A45C 13/262; A45C 2005/148
USPC ..... 190/115, 18 A; 280/47.371
See application file for complete search history.

(56) References Cited

U.S. PATENT DOCUMENTS

| | | | | |
|---|---|---|---|---|
| 44,936 | A | 11/1864 | Clapp | |
| 1,176,876 | A * | 3/1916 | Vartabedian | 280/35 |
| 2,463,713 | A | 3/1949 | Partiot | |
| 2,539,993 | A | 1/1951 | Davis | |
| 3,141,680 | A | 7/1964 | McCord et al. | |
| 3,197,226 | A | 7/1965 | Erlinder | |
| 3,376,047 | A | 4/1968 | Schuster | |
| 4,254,850 | A | 3/1981 | Knowles | |
| 4,588,055 | A | 5/1986 | Chen | |
| 4,773,123 | A | 9/1988 | Yu | |
| 5,303,805 | A | 4/1994 | Hauser | |
| 5,348,336 | A * | 9/1994 | Fernie et al. | 280/641 |
| 5,431,262 | A | 7/1995 | Rekuc et al. | |
| 5,524,737 | A | 6/1996 | Wang | |
| 5,533,231 | A | 7/1996 | Bai | |
| 5,564,538 | A | 10/1996 | Sadow | |
| 5,813,503 | A | 9/1998 | Chang | |
| 6,131,928 | A * | 10/2000 | Tung | 280/47.315 |
| 6,176,357 | B1 | 1/2001 | Kuo | |
| 6,179,176 | B1 | 1/2001 | Saggese et al. | |
| 6,196,561 | B1 | 3/2001 | Trassinelli | |
| 6,220,412 | B1 | 4/2001 | Lin | |
| 6,289,554 | B1 | 9/2001 | Wang | |
| 6,360,400 | B1 | 3/2002 | Chang | |

(Continued)

FOREIGN PATENT DOCUMENTS

FR 1145985 * 5/1957

*Primary Examiner* — Sue A Weaver

(74) *Attorney, Agent, or Firm* — JP Webb; Jason P. Webb; Danny Y. H. Cheng

(57) ABSTRACT

A wheel deployment apparatus having a retractable wheel assembly. The wheel deployment apparatus includes a deployment cable functionally coupled to and extending from the wheel assembly. The apparatus includes a retractable handle assembly having a primary tube telescopically nested with a secondary tube. The wheel deployment apparatus includes a shuttle slidably coupled between the primary tube and the secondary tube and coupled to the deployment cable through a slot in the retractable handle assembly. The wheel deployment apparatus includes a shuttle cover functionally disposed over the slot having a hole through which the deployment cable extends.

14 Claims, 7 Drawing Sheets

(56) References Cited

U.S. PATENT DOCUMENTS

| | | | | |
|---|---|---|---|---|
| 6,367,602 | B1 | 4/2002 | Chang | |
| 6,401,888 | B1 * | 6/2002 | Kuo | 190/18 A |
| 6,454,065 | B1 | 9/2002 | Chen | |
| 6,550,967 | B2 | 4/2003 | Hedaya | |
| 6,604,615 | B2 | 8/2003 | Wu | |
| 6,612,411 | B2 | 9/2003 | Nykoluk et al. | |
| 6,802,515 | B2 | 10/2004 | Sorenson et al. | |
| 7,066,311 | B2 | 6/2006 | O'Shea | |
| 7,165,661 | B2 | 1/2007 | Miyoshi | |
| 7,861,834 | B2 | 1/2011 | Gorga et al. | |
| 8,757,642 | B2 * | 6/2014 | Arthur et al. | 280/37 |
| 2001/0032765 | A1 * | 10/2001 | Tiramani et al. | 190/115 |
| 2002/0032950 | A1 * | 3/2002 | Kuo | 16/113.1 |
| 2004/0000457 | A1 * | 1/2004 | Sanford-Schwentke | 190/18 A |
| 2004/0163910 | A1 | 8/2004 | Lee | |
| 2008/0236972 | A1 | 10/2008 | Lee et al. | |
| 2009/0160147 | A1 | 6/2009 | Arthur | |

* cited by examiner

WHEEL DEPLOYMENT APPARATUS

BACKGROUND OF THE INVENTION

1. Field of the Invention

The present invention relates to wheel assemblies, specifically to a wheel deployment apparatus.

2. Description of the Related Art

Luggage, including suitcases and the like, is often heavy, bulky, and generally unwieldy. Travelers, in particular, often have multiple articles of luggage, which are not easily simultaneously transported by a single person. Although suitcases are frequently provided with wheels, the user must wither hunch over, or otherwise lower his or her arms, in order to grasp the handle of the suitcase while the wheels contact the floor, or stand erect and carry the suitcase, and often project the suitcase. Further, wheel assemblies project from suitcases and may be damaged during handling by the airlines. Also, such may present difficulties when the user wishes to have the suitcase stably positioned on the floor.

A separate luggage carrier with wheels and an extendible handles may be utilized to overcome these problems. However, such carriers have open frames that leave the wheel assemblies of the luggage carriers exposed to damage during handling by the airlines.

Retractable wheels and/or handles are known in the art and are generally provided to help reduce exposure of the wheels to the exterior. Different retraction mechanisms are used to provide different operational characteristics to varying degrees of success.

Some improvements have been made in the field. Examples of references related to the present invention are described below in their own words, and the supporting teachings of each reference are incorporated by reference herein:

U.S. Pat. No. 5,431,262, issued to Rekuc et al., discloses an article of luggage has a handle received in a frame disposed along the interior rear wall of a flexible case to allow the article to be pulled along the ground or floor on wheels mounted in a wheel assembly affixed to the bottom of an article. The bottom plate has a pull-out ledge on which other luggage can be mounted and held in place by an elastic strap which is affixed to the case and can encircle the additional article or be buckled out of the way along the outer rear wall of the case.

U.S. Pat. No. 7,165,661, issued to Miyoshi, discloses a bag mounted with casters has a bag body attached to a base frame mounted with the casters at four corners of a bottom surface thereof. The base frame includes a loading table, and vertically extensible rods with a grip mounted at upper ends thereof. The extensible rods are fixed on one side of the loading table so as to stand on their own. Further, when the grip is raised, the extensible rods are curved or tilted so that the grip moves toward the middle of the loading table. The extensible rods are secured at a position in a retracted state by stoppers so that the grip is positioned at an upper portion of the bag body or above the bag body, and are secured at a position by the stoppers in an extended state so that a height of the grip from the bottoms of the casters is in a range of 60 to 100 cm.

U.S. Pat. No. 5,513,873, issued to Chen, discloses a handle of a push cart includes two rods slidably engaged in two tubes and each having a number of teeth. Two sleeves are secured on top of the tubes and each has a pair of lugs. Two pins are secured between the lugs. A resilient arm has two ends slidably engaged with the pins, the ends each includes a tooth for engaging with the teeth of the rods so as to secure the rods to the tubes. The teeth of the resilient arm are disengaged from the teeth of the rods when the resilient arm is depressed. A fence is secured to the sleeves for preventing the resilient arm from being depressed inadvertently.

U.S. Pat. No. 5,524,737, issued to Wang, discloses a retractable handle and wheel assembly includes a flat handle mounting frame and a circularly arched wheel mounting frame joined together and mounted on the back and bottom panel of a collapsible travel bag. Two wheel holders are respectively fastened to the wheel mounting frame each wheel holder having a wheel coupling portion fitted over a respective recessed hole on the wheel mounting frame to hold a respective wheel by a bearing and a channel bar bearing block fixedly fastened to the handle mounting frame to hold a respective channel bar, with a retractable handle sliding in an out of the channel bars, the retractable handle having two rubber blocks at two adjacent ends for positioning the handle at either end of each channel bar to hold the handle in the collapsed or extended out position.

U.S. Pat. No. 3,376,047,issued to Schuster, discloses a collapsible vehicle for the transportation of tools, suitcases, shopping bags, sport equipment, etc., which includes a frame of isosceles trapezoidal configuration defined by hingedly interconnected member cooperating with a support and a releasable latch, the front and rear members having a total length equal to the combined length of the size of the trapezoid, which is swingable so that the members can lie substantially parallel to one another.

The inventions heretofore known suffer from a number of disadvantages which include being limited in use, being limited in adaptability, being limited in application, being unable to fully close and secure the wheel therein, being bulky, being difficult to adapt to existing luggage, being expensive, being less durable, being subject to damage during use or storage, causing damage to surrounding materials during use or storage, failing to protect a user's investment in their luggage, failing to increase a perceived value of the luggage, causing frustration to users when trying to store luggage in overhead bins, failing to permit refitting of existing containers, causing damage during unintentional deployment, permitting unintentional deployment, failing to prevent intrusion by foreign objects into a retraction mechanism, being heavy, taking up too much interior luggage space, taking up too much exterior luggage space, and not permitting independent wheel deployment and the like and combinations thereof.

What is needed is a wheel deployment apparatus that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available wheel deployment apparatuses. Accordingly, the present invention has been developed to provide an effective and efficient wheel deployment apparatus in deploying a retractable wheel assembly.

According to one embodiment of the invention, there is a wheel deployment apparatus that may have a retractable wheel assembly. The retractable wheel assembly may include a bracing member. The bracing member may include a side panel and a front panel that may be coupled to the side panel and may have an aperture disposed therethrough.

The retractable wheel assembly may include a wheeled arm that may be pivotally coupled to the side panel and may be sized and positioned such that the wheeled arm rotates through the aperture of the front panel. The wheeled arm may include an arm member that may have a first end and a second end. The arm member may be pivotally coupled to the side panel, between the first end and the second end. The wheeled arm may include a wheel that may be coupled to the first end of the arm member. The wheeled arm may include an aperture cover that may be coupled to the arm member.

The retractable wheel assembly may include a deployment hub that may be operationally coupled to the wheeled arm such that rotation of the deployment hub rotates the wheeled arm, between an extended mode and a retracted mode. The retractable wheel assembly may include a cable that may be operationally coupled to the deployment hub and wound there about, such that pulling the cable causes rotation of the deployment hub. The retractable wheel assembly may include a biased assembly that may be operationally coupled to the wheeled arm and may be configured to bias the wheeled arm in a retracted mode.

The wheel deployment apparatus may include a deployment cable that may be functionally coupled to and extending from the wheel assembly. The apparatus may include a retractable handle assembly that may have a primary tube telescopically nested with a secondary tube, the secondary tube may be coupled to a handle. The secondary tube may include a protrusion at a bottom region thereof that may be shaped and positioned to engage the shuttle as the secondary tube is telescopically withdrawn from the primary tube and thereby force the shuttle to travel along the slot as the secondary tube is further withdrawn. The secondary tube may be nested within the primary tube and the shuttle may be disposed within the primary tube, between an outer surface of the secondary tube and an inner surface of the primary tube.

The wheel deployment apparatus may include a shuttle that may be slidably coupled between the primary tube and the secondary tube and coupled to the deployment cable through a slot in the retractable handle assembly. The shuttle may include an elevated receiving channel that may be extending through the slot, the channel may be configured to receive and securely couple to the deployment cable.

The wheel deployment apparatus may include a shuttle cover that may be functionally disposed over the slot that may include a hole through which the deployment cable extends. The shuttle cover may be rigid and substantially envelopes the slot and any portion of the shuttle which extends therethrough. The shuttle cover may include a one-way coupling structure that may be configured to selectably couple to the handle assembly but to resist removal therefrom. The apparatus may include a rigid shuttle cover that may be disposed over the slot and having a cover channel shaped to protect a travel path of the elevated receiving channel of the shuttle during the operation thereof. The wheel deployment apparatus may include a sheath that may be disposed about the deployment cable and may be fixedly coupled to the hole of the shuttle cover.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
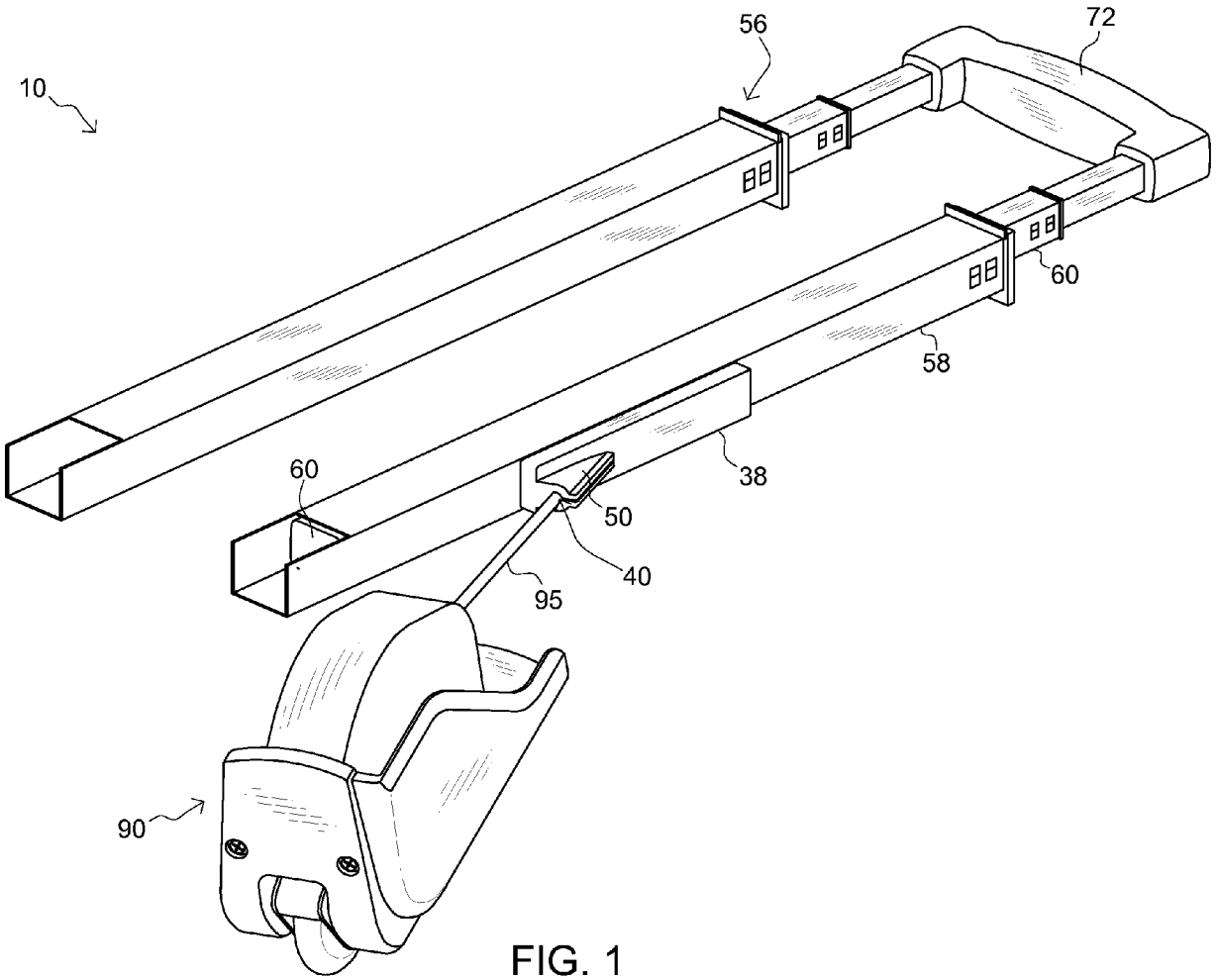
FIG. 1 is a perspective view of a wheel deployment apparatus, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a wheel deployment apparatus, according to one embodiment of the invention. There is shown a wheel deployment apparatus 10 including a retractable wheel assembly 90, a deployment cable 95, a retractable handle assembly 56, and a shuttle cover 38.

The illustrated wheel deployment apparatus 10 is designed specifically for personal luggage and smaller containers. Such may be specifically designed to be cost effective in manufacturing, given the intended use. Such an apparatus 10 allows for use in presently existing products with minimal changes to their manufacturing processes and costs.

The illustrated wheel deployment apparatus 10 includes a retractable wheel assembly 90. The wheel deployment apparatus 10 includes a deployment cable 95 functionally coupled to and extending from the wheel assembly 90. The retractable wheel assembly 90 is designed to fit within a personal luggage or container, without occupying interior space of the luggage or container. The retractable wheel assembly 90 is configured to retract a wheel from the luggage or container when deployed by a retractable handle assembly 56, thereby providing mobility capabilities.

The retractable handle assembly 56 includes a primary tube 58 telescopically nested with a secondary tube 60, the secondary tube 60 is coupled to a handle 72. The secondary tube 60 is nested within the primary tube 58; wherein the wheel deployment apparatus 10 includes a shuttle disposed within the primary tube 58, between an outer surface of the secondary tube 60 and an inner surface of the primary tube 58.

The illustrated wheel deployment apparatus 10 includes a shuttle cover 38 functionally disposed over a slot, wherein the shuttle cover 38 includes a hole through which the deployment cable 95 extends. The shuttle cover 38 is rigid and substantially envelopes the slot and any portion of the shuttle which extends therethrough. The shuttle cover 38 includes a one-way coupling structure configured to selectably couple to the handle assembly 56 but to resist removal therefrom. The wheel deployment apparatus 10 includes a sheath 50 disposed about the deployment cable 95 and fixedly coupled to the hole of the shuttle cover 38. The illustrated shuttle cover 38 is functionally coupled to the primary tube 58 of the retractable handle assembly 56.

Figure 2:
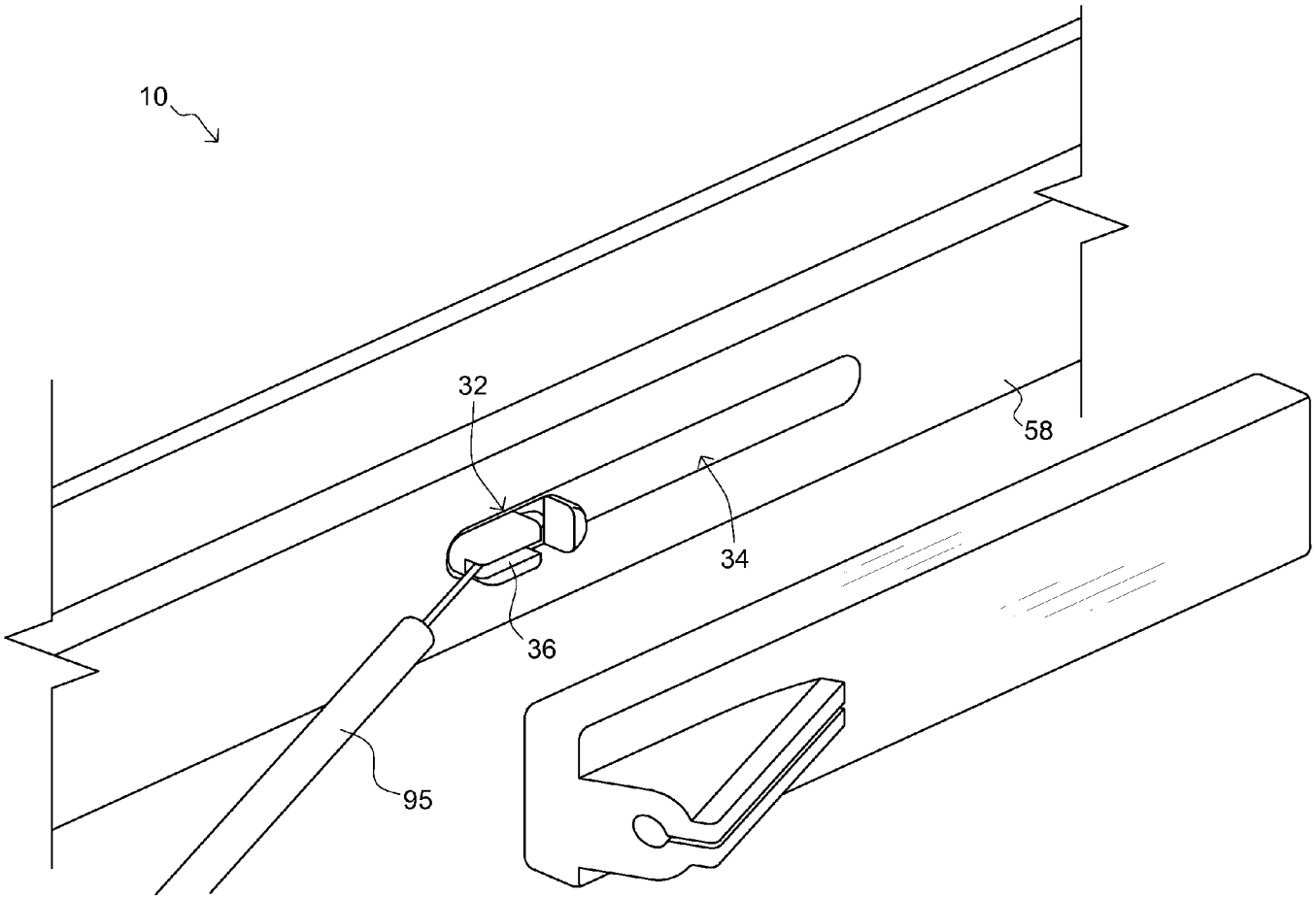
FIG. 2 is a perspective view of a shuttle of a wheel deployment apparatus, according to one embodiment of the invention.

FIG. 2 is a perspective view of a shuttle of a wheel deployment apparatus, according to one embodiment of the invention. There is shown a deployment cable 95 functionally coupled to a shuttle 32 and a primary tube 58 of a wheel deployment apparatus 10. The illustrated shuttle cover is present but not illustrated as being functionally coupled to the structure in order to better view the underlying structure. In operation, the shuttle cover is disposed against the side of the primary tube (see FIG. 1) and couple thereto, covering the shuttle and the entire length of the aperture through which the shuttle extends, with the deployment cable extending through the aperture through the shuttle cover and the cover to the cable being coupled to that point, such as but not limited to by friction fitting, glue, pins, etc. so that the cover to the cable does not retract or sag and the cable is thereby not exposed to exterior manipulation.

The illustrated wheel deployment apparatus 10 includes a deployment cable 95 functionally coupled to and extending from a wheel assembly. The apparatus 10 includes a primary tube 58 of a retractable handle assembly telescopically nested with a secondary tube. The wheel deployment apparatus 10 includes a shuttle 32 functionally coupled to the secondary tube, wherein the shuttle 32 is resting within a slot 34. The slot 34 is disposed through the primary tube 58 of the retractable handle assembly to keep the shuttle 32 on tract during operation and use.

The illustrated wheel deployment apparatus 10 includes a shuttle 32 slidably coupled between the primary tube 58 and the secondary tube and coupled to the deployment cable 95 through the slot 34 in the retractable handle assembly. The shuttle 32 includes an elevated receiving channel 36 extending through the slot 34, the channel 36 is configured to receive and securely couple to the deployment cable 95.

Figure 3:
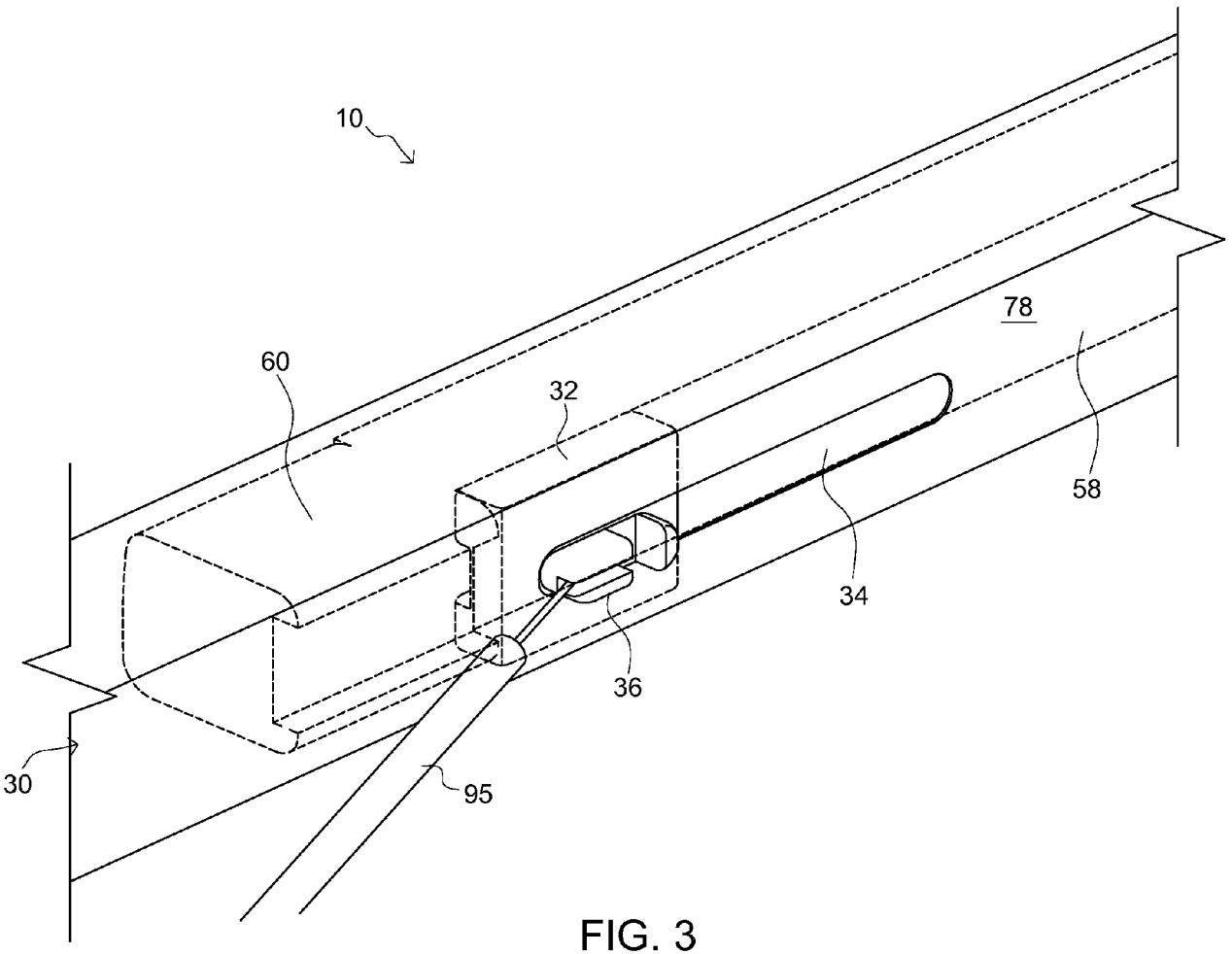
FIG. 3 is a partial cut-away perspective view of a shuttle and a shuttle cover of a wheel deployment apparatus, according to one embodiment of the invention.

FIG. 3 is a partial cut-away perspective view of a shuttle and a shuttle cover of a wheel deployment apparatus, according to one embodiment of the invention. There is shown a deployment cable 95 functionally coupled to a shuttle 32, a secondary tube 60 and a primary tube 58 of a retractable handle assembly.

The illustrated wheel deployment apparatus 10 includes a deployment cable 95 functionally coupled to and extending from a wheel assembly. The apparatus 10 includes a retractable handle assembly having a primary tube 58 telescopically nested with a secondary tube 60. The secondary tube 60 is nested within the primary tube 58, wherein the apparatus 10 includes a shuttle 32 disposed within the primary tube 58, between an outer surface 78 of the secondary tube 60 and an inner surface 30 of the primary tube 58.

The illustrated wheel deployment apparatus 10 includes a shuttle 32 slidably coupled between the primary tube 58 and the secondary tube 60 and coupled to the deployment cable 95 through the slot 34 of the retractable handle assembly. The shuttle 32 includes an elevated receiving channel 36 extending through the slot 34, the channel 36 is configured to receive and securely couple to the deployment cable 95. The shuttle is shaped and sized to slide inside the primary tube and to project within that cavity sufficiently such that as the secondary tube travels through an interior of the primary tube it will catch the shuttle at position along such travel and then induce the shuttle to travel along therewith (see the L-shaped protrusions of the secondary tube that engage with a bottom portion of the shuttle as the secondary tube is withdrawn from being nested within the primary tube). The specific engagement structure in combination with the shape and size of the shuttle will determine the specific point at which the secondary tube engages with the shuttle and then causes the shuttle to begin its ascent. Accordingly, the structure may be "tuned" such that the shuttle pulls on the deployment cable (thus causing the wheel to deploy) at a specific and predetermined point during the handle retraction process.

Figure 4:
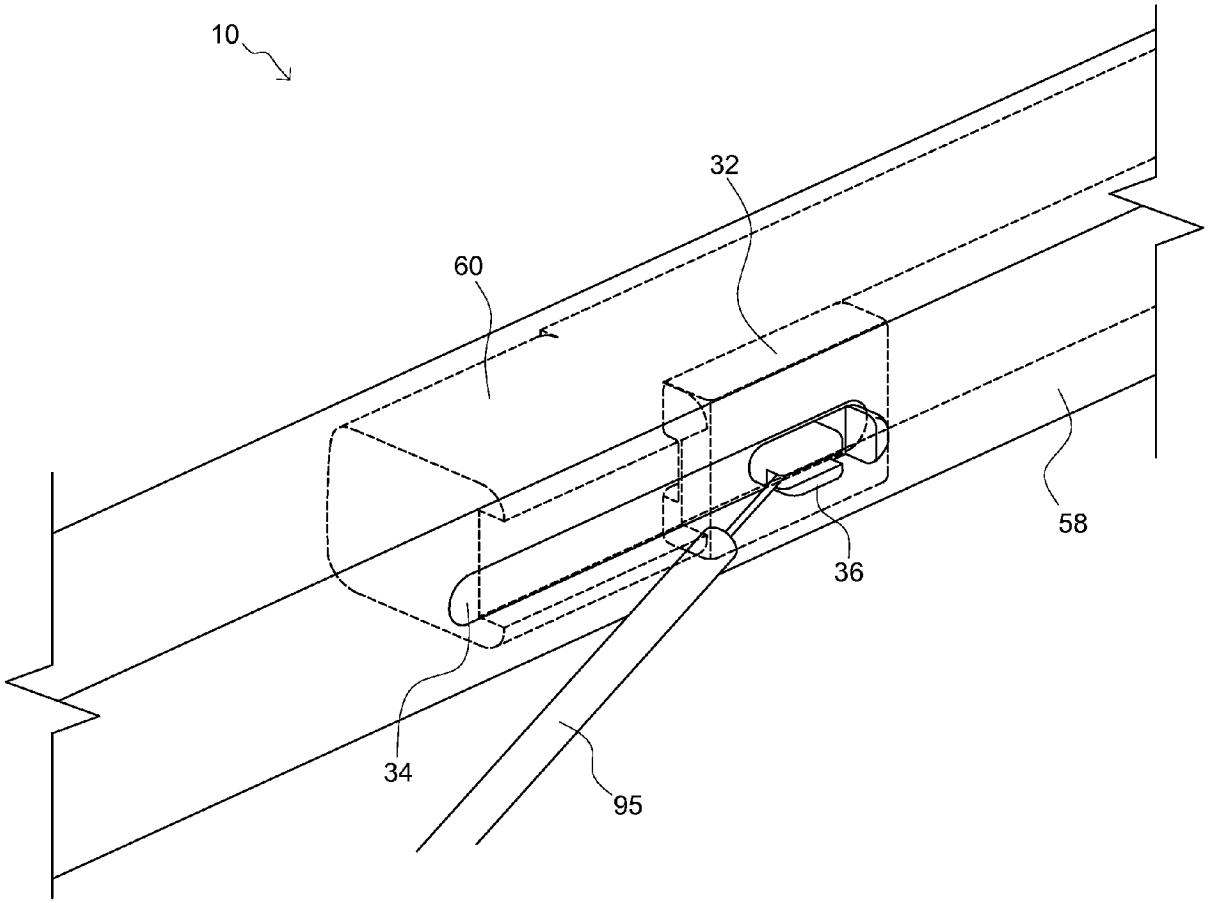
FIG. 4 is a partial cut-away perspective view of a shuttle and a shuttle cover of a wheel deployment apparatus, according to one embodiment of the invention.

FIG. 4 is a partial cut-away perspective view of a shuttle of a wheel deployment apparatus, according to one embodiment of the invention. There is shown a deployment cable 95 functionally coupled to a shuttle 32, a secondary tube 60 and a primary tube 58 of a retractable handle assembly.

The illustrated wheel deployment apparatus 10 includes a deployment cable 95 functionally coupled to and extending from a wheel assembly functionally disposed within a luggage or container. The apparatus 10 includes a retractable handle assembly having a primary tube 58 telescopically nested with a secondary tube 60.

The illustrated wheel deployment apparatus 10 includes a shuttle 32 slidably coupled between the primary tube 58 and the secondary tube 60 and coupled to the deployment cable 95 through a slot 34 of the retractable handle assembly. The shuttle 32 includes an elevated receiving channel 36 extending through the slot 34, the channel 36 is configured to receive and securely couple to the deployment cable 95.

Figure 5:
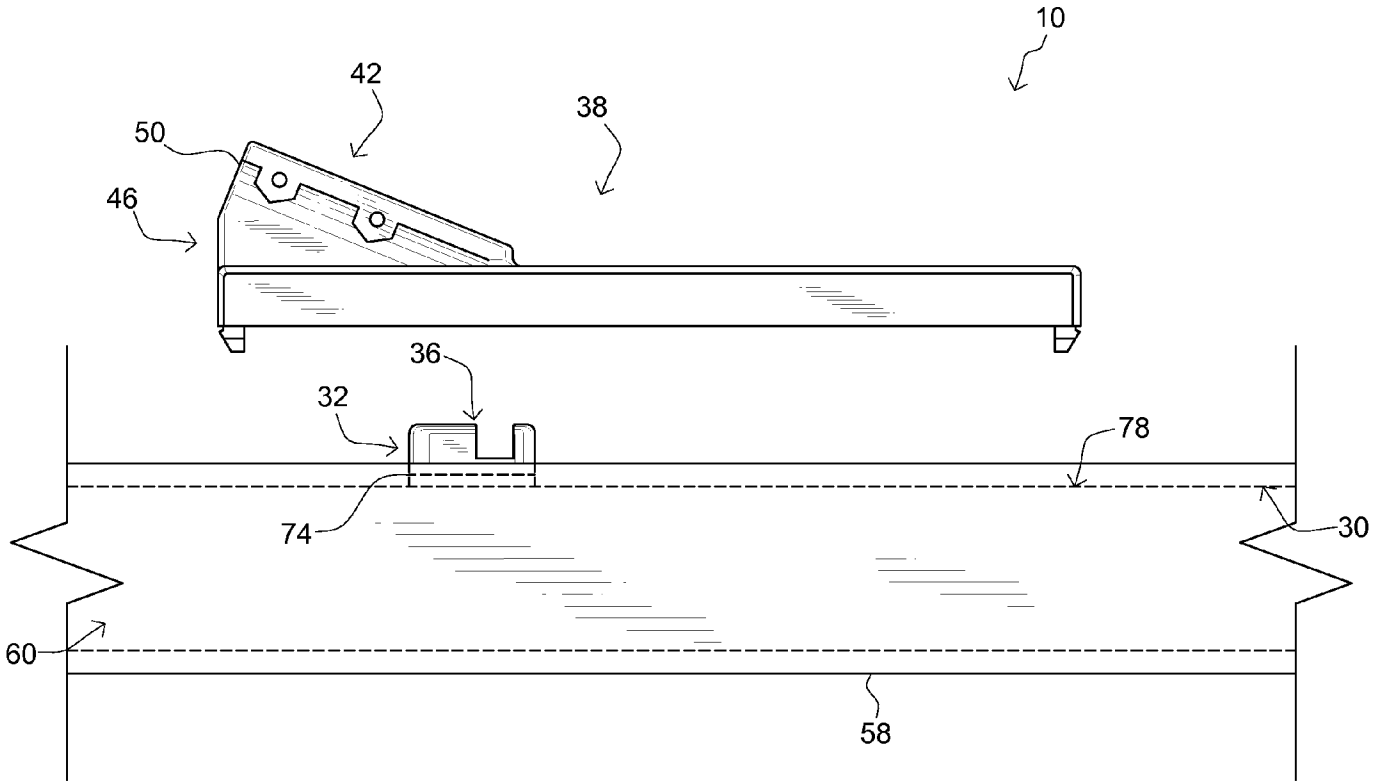
FIG. 5 is a side elevational view of a primary tube, shuttle, and a shuttle cover of a wheel deployment apparatus, according to one embodiment of the invention.

FIG. 5 is a side elevational view of a primary tube, a shuttle, and a shuttle cover of a wheel deployment apparatus, according to one embodiment of the invention. There is shown a primary tube 58, a shuttle 32, and a shuttle cover 38.

The illustrated wheel deployment apparatus 10 includes a retractable handle assembly having a primary tube 58 telescopically nested with a secondary tube 60. The secondary tube 60 includes a protrusion 74 at a bottom region thereof shaped and positioned to engage a shuttle 32 as the secondary tube 60 is telescopically withdrawn from the primary tube 58 and the shuttle 32 travels along a slot as the secondary tube 60 is further withdrawn.

The illustrated wheel deployment apparatus 10 includes a shuttle 32 slidably coupled between the primary tube 58 and the secondary tube 60 and coupled to a deployment cable through the slot. The shuttle 32 includes an elevated receiving channel 36 extending through the slot, the channel 36 is configured to receive and securely couple to the deployment cable.

The illustrated secondary tube 60 is nested within the primary tube 58 and the shuttle 32 is disposed within the primary tube 58, between an outer surface 78 of the secondary tube 60 and an inner surface 30 of the primary tube 58.

The wheel deployment apparatus 10 includes a shuttle cover 38 functionally disposed over a slot including a hole through which a deployment cable extends and couples to the shuttle 32. The shuttle cover 38 is rigid and substantially envelopes the slot and any portion of the shuttle 32 which extends therethrough. The shuttle cover 38 includes a one-way coupling structure 42 configured to selectably couple to the handle assembly but to resist removal therefrom.

The illustrated apparatus 10 includes a rigid shuttle cover 38 disposed over the slot and having a cover channel 46 shaped to protect a travel path of the elevated receiving channel 36 of the shuttle 32 during the operation thereof. The wheel deployment apparatus 10 includes a sheath 50 disposed about the deployment cable and fixedly coupled to a hole of the shuttle cover 38.

Figure 6:
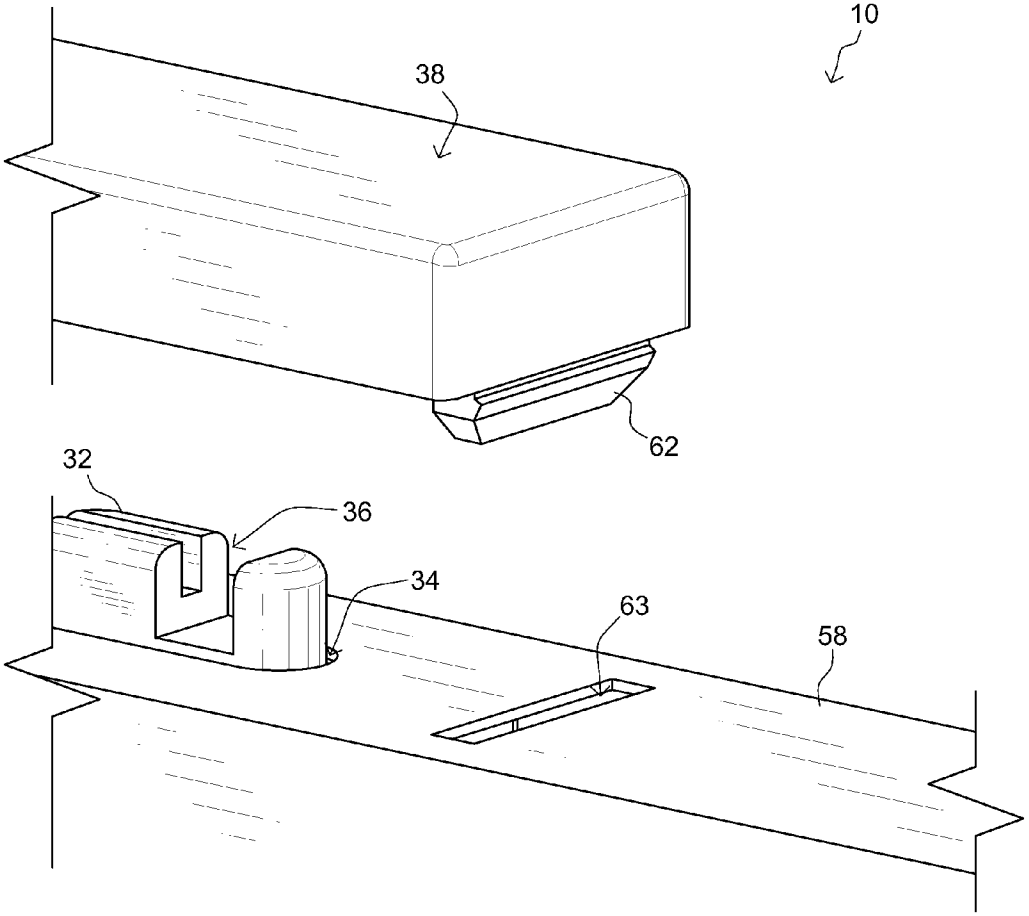
FIG. 6 is a perspective view of a primary tube, a shuttle, and a shuttle cover of a wheel deployment apparatus, according to one embodiment of the invention.

FIG. 6 is a perspective view of a primary tube, a shuttle, and a shuttle cover of a wheel deployment apparatus, according to one embodiment of the invention. There is shown a shuttle 32, a shuttle cover 38, and a primary tube 58.

The illustrated wheel deployment apparatus 10 includes a primary tube 58 and a shuttle 32; wherein the shuttle 32 is slidably coupled between the primary tube 58 and a secondary tube of a retractable handle assembly. The shuttle 32 is coupled to a deployment cable of a retractable wheel assembly. The shuttle 32 includes an elevated receiving channel 36 extending through a slot; wherein the channel 36 is configured to receive and securely couple to the deployment cable.

The wheel deployment apparatus 10 includes a shuttle cover 38 functionally disposed over the slot 34. The shuttle cover 38 is rigid and substantially envelopes the slot and any portion of the shuttle 32 which extends therethrough. The illustrated shuttle cover 38 is functionally coupled to the primary tube 58 by a hole 63 and a protrusion 62.

Figure 7:
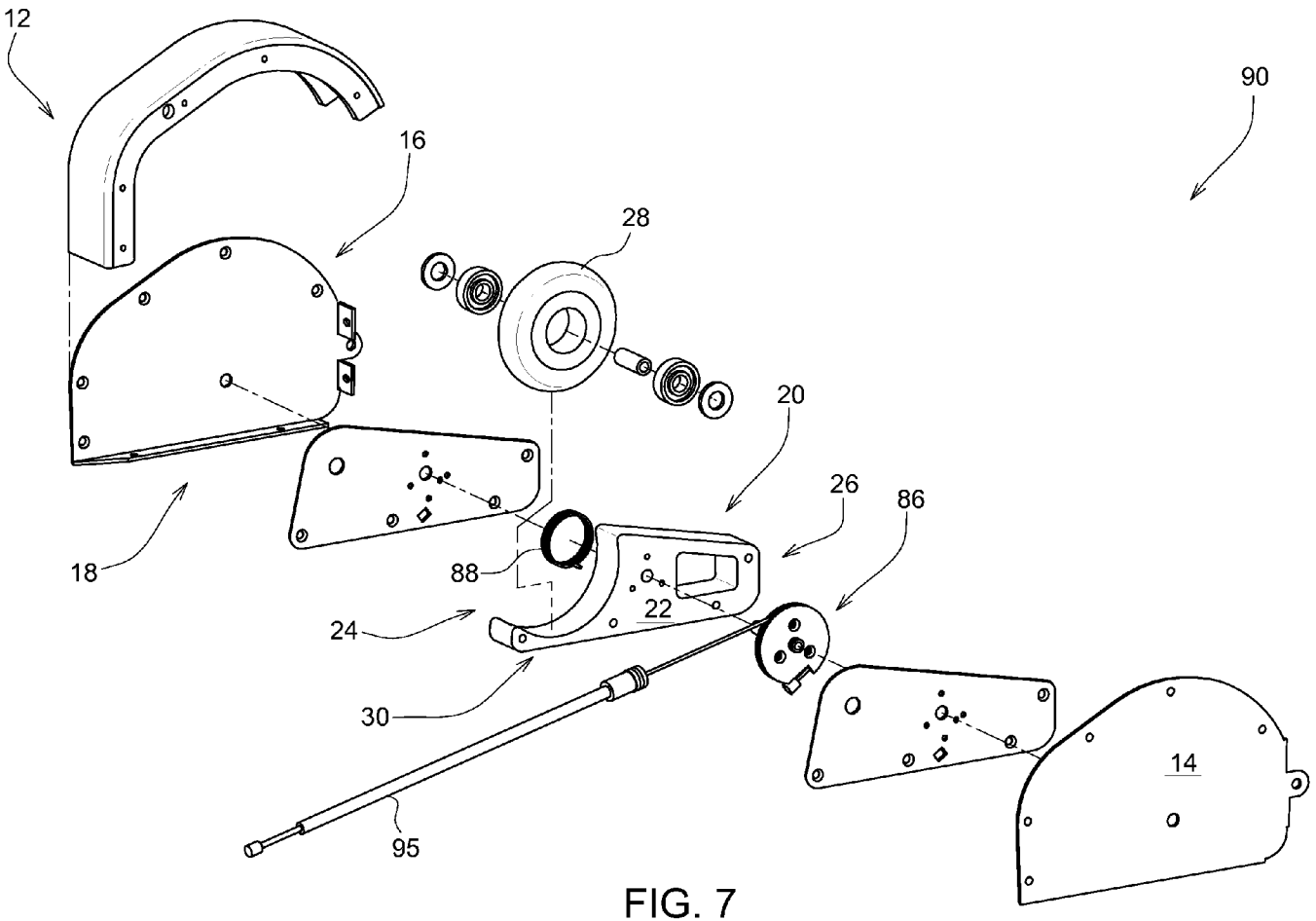
FIG. 7 is an exploded view of a retractable wheel assembly, according to one embodiment of the invention.

FIG. 7 is an exploded view of a retractable wheel assembly, according to one embodiment of the invention. There is shown a retractable wheeled assembly 90 having a bracing member 12, a wheeled arm 20, a deployment hub 86, a cable 95, and a biased member 88.

The illustrated wheel assembly 90 includes a bracing member 12. The bracing member 12 includes a side panel 14. The bracing member 12 includes a front panel 16 configured to couple to the side panel 14. The front panel 16 includes an aperture 18 disposed therethrough. The wheel assembly 90 includes a wheeled arm 20 configured to be pivotally coupled to the side panel 14. The wheeled arm 20 is sized and positioned such that the wheeled arm 20 is configured to rotate through the aperture 18 of the front panel 16 in a deployed mode.

The wheeled arm 20 includes an arm member 22 that includes a first end 24 and a second end 26. The arm member 22 is pivotally coupled to the side panel 14, between the first end 24 and the second end 26. The wheeled arm 20 includes a wheel 28 coupled to the first end 24 of the arm member 22. The wheeled arm 20 includes an aperture cover 30 coupled to the arm member 22.

The wheel assembly 90 includes a deployment hub 86 operationally coupled to the wheeled arm 20 such that rotation of the deployment hub 86 rotates the wheeled arm 20, between a deployed mode and a retracted mode. The wheel assembly 90 includes a cable 95 operationally coupled to the deployment hub 86 and is wound there about, such that pulling the cable 95 causes rotation of the deployment hub 86, and thereby deployment of the wheel 28 through the aperture 18 of the front panel 16. The wheel assembly 90 also includes a biased assembly 88 operationally coupled to the wheeled arm 20 and configured to bias the wheeled arm 20 in a retracted mode. The illustrated bias member 88 is a torsion spring and other bias members are contemplated including but not limited to other kinds of springs, such as but not limited to leaf springs, coil springs, compression springs, tension springs, clock springs, and the like and combinations thereof.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A wheel deployment apparatus, comprising:

a) a retractable wheel assembly;

b) a deployment cable functionally coupled to and extending from the wheel assembly;

c) a retractable handle assembly having a primary tube telescopically nested with a secondary tube, the secondary tube being coupled to a handle;

d) a shuttle slidably coupled between the primary tube and the secondary tube and coupled to the deployment cable through a slot in the retractable handle assembly; and e) a shuttle cover functionally disposed over the slot including a hole through which the deployment cable extends; wherein the shuttle cover is rigid and substantially envelopes the slot and any portion of the shuttle which extends therethrough.

2. The apparatus of claim 1, wherein the retractable wheel assembly, includes:

a) a bracing member, including:

a1) a side panel; and a2) a front panel coupled to the side panel and including an aperture disposed therethrough;

b) a wheeled arm pivotally coupled to the side panel and sized and positioned such that the wheeled arm rotates through the aperture of the front panel; wherein the wheeled arm further comprises:

b1) an arm member including a first end and a second end; wherein the arm member is pivotally coupled to the side panel, between the first end and the second end;

b2) a wheel coupled to the first end of the arm member; and b3) an aperture cover coupled to the arm member;

c) a deployment hub operationally coupled to the wheeled arm such that rotation of the deployment hub rotates the wheeled arm, between an extended mode and a retracted mode;

d) wherein the deployment cable is operationally coupled to the deployment hub and wound there about, such that pulling the deployment cable causes rotation of the deployment hub; and e) a biased assembly operationally coupled to the wheeled arm and configured to bias the wheeled arm in a retracted mode.

3. The apparatus of claim 1, wherein the shuttle includes an elevated receiving channel extending through the slot, the channel being configured to receive and securely couple to the deployment cable.

4. The apparatus of claim 1, wherein the shuttle cover includes a one-way coupling structure configured to selectably couple to the handle assembly but to resist removal therefrom.

5. The apparatus of claim 1, wherein the secondary tube includes a protrusion at a bottom region thereof that is shaped and positioned to engage the shuttle as the secondary tube is telescopically withdrawn from the primary tube and thereby force the shuttle to travel along the slot as the secondary tube is further withdrawn.

6. The apparatus of claim 1, further comprising a sheath disposed about the deployment cable and fixedly coupled to the hole of the shuttle cover.

7. The apparatus of claim 1, wherein the secondary tube is nested within the primary tube and the shuttle is disposed within the primary tube, between an outer surface of the secondary tube and an inner surface of the primary tube.

8. A wheel deployment apparatus, comprising:

a) a retractable wheel assembly;

b) a deployment cable functionally coupled to and extending from the wheel assembly;

c) a retractable handle assembly having a primary tube telescopically nested with a secondary tube, the secondary tube being coupled to a handle;

d) a shuttle slidably coupled between the primary tube and the secondary tube and coupled to the deployment cable through a slot in the retractable handle assembly;

wherein the secondary tube includes a protrusion at a bottom region thereof that is shaped and positioned to engage the shuttle as the secondary tube is telescopically withdrawn from the primary tube and thereby force the shuttle to travel along the slot as the secondary tube is further withdrawn; and e) a rigid shuttle cover disposed over the slot and having a cover channel shaped to protect a travel path of an elevated receiving channel of the shuttle during the operation thereof; wherein the shuttle cover includes a one-way coupling structure configured to selectably couple to the handle assembly but to resist removal therefrom.

9. The apparatus of claim 8, wherein the elevated receiving channel extends through the slot, the channel being configured to receive and securely couple to the deployment cable.

10. The apparatus of claim 9, wherein the secondary tube is nested within the primary tube and the shuttle is disposed within the primary tube, between an outer surface of the secondary tube and an inner surface of the primary tube.

11. The apparatus of claim 10, wherein the shuttle cover is functionally disposed over the slot and includes a hole through which the deployment cable extends.

12. The apparatus of claim 11, wherein the retractable wheel assembly, includes:

a) a bracing member, including:

a1) a side panel; and a2) a front panel coupled to the side panel and including an aperture disposed therethrough;

b) a wheeled arm pivotally coupled to the side panel and sized and positioned such that the wheeled arm rotates through the aperture of the front panel; wherein the wheeled arm further comprises:

b1) an arm member including a first end and a second end; wherein the arm member is pivotally coupled to the side panel, between the first end and the second end;

b2) a wheel coupled to the first end of the arm member; and b3) an aperture cover coupled to the arm member;

c) a deployment hub operationally coupled to the wheeled arm such that rotation of the deployment hub rotates the wheeled arm, between an extended mode and a retracted mode;

d) wherein the deployment cable is operationally coupled to the deployment hub and wound there about, such that pulling the deployment cable causes rotation of the deployment hub; and e) a biased assembly operationally coupled to the wheeled arm and configured to bias the wheeled arm in a retracted mode.

13. The apparatus of claim 11, further comprising a sheath disposed about the deployment cable and fixedly coupled to the hole of the shuttle cover.

14. A wheel deployment apparatus, comprising:

a) a retractable wheel assembly; wherein the retractable wheel assembly, includes:

a1) a bracing member, including:

aa1) a side panel; and aa2) a front panel coupled to the side panel and including an aperture disposed therethrough;

b1) a wheeled arm pivotally coupled to the side panel and sized and positioned such that the wheeled arm rotates through the aperture of the front panel; wherein the wheeled arm further comprises:

bb1) an arm member including a first end and a second end;

wherein the arm member is pivotally coupled to the side panel, between the first end and the second end;

bb2) a wheel coupled to the first end of the arm member; and bb3) an aperture cover coupled to the arm member;

c1) a deployment hub operationally coupled to the wheeled arm such that rotation of the deployment hub rotates the wheeled arm, between an extended mode and a retracted mode;

d1) a deployment cable operationally coupled to the deployment hub and wound there about, such that pulling the cable causes rotation of the deployment hub; and e1) a biased assembly operationally coupled to the wheeled arm and configured to bias the wheeled arm in a retracted mode;

b) wherein the deployment cable is functionally coupled to and extending from the wheel assembly;

c) a retractable handle assembly having a primary tube telescopically nested with a secondary tube, the secondary tube being coupled to a handle;

d) a shuttle slidably coupled between the primary tube and the secondary tube and coupled to the deployment cable through a slot in the retractable handle assembly;

wherein the shuttle includes an elevated receiving channel extending through the slot, the channel being configured to receive and securely couple to the deployment cable;

wherein the secondary tube includes a protrusion at a bottom region thereof that is shaped and positioned to engage the shuttle as the secondary tube is telescopically withdrawn from the primary tube and thereby force the shuttle to travel along the slot as the secondary tube is further withdrawn; wherein the secondary tube is nested within the primary tube and the shuttle is disposed within the primary tube between an outer surface of the secondary tube and an inner surface of the primary tube;

e) a shuttle cover functionally disposed over the slot including a hole through which the deployment cable extends; wherein the shuttle cover is rigid and substantially envelopes the slot and any portion of the shuttle which extends therethrough; wherein the shuttle cover includes a one-way coupling structure configured to selectably couple to the handle assembly but to resist removal therefrom; and f) a sheath disposed about the deployment cable and fixedly coupled to the hole of the shuttle cover.

* * * * *